US007351511B2

(12) United States Patent
Kurokawa et al.

(10) Patent No.: US 7,351,511 B2
(45) Date of Patent: Apr. 1, 2008

(54) LIQUID DEVELOPER AND IMAGE FORMING APPARATUS USING SAME

(75) Inventors: Naonori Kurokawa, Kanagawa (JP); Tsutomu Teraoka, Kanagawa (JP); Eishu Ohdake, Tokyo (JP); Tsuneo Kurotori, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 284 days.

(21) Appl. No.: 11/149,199

(22) Filed: Jun. 10, 2005

(65) Prior Publication Data

US 2005/0287481 A1 Dec. 29, 2005

(30) Foreign Application Priority Data

Jun. 14, 2004 (JP) ..... 2004-175430

(51) Int. Cl.
*G03G 9/12* (2006.01)

(52) U.S. Cl. ..... 430/118.7; 430/119.6

(58) Field of Classification Search ..... 430/118.7, 430/119.6

See application file for complete search history.

(56) References Cited

U.S. PATENT DOCUMENTS

| | | | | |
|---|---|---|---|---|
| 7,153,332 | B2 * | 12/2006 | Hasemann | 8/639 |
| 2002/0085860 | A1 | 7/2002 | Itaya | |
| 2003/0086735 | A1 | 5/2003 | Payne et al. | |
| 2006/0101595 | A1 * | 5/2006 | Hasemann | 8/536 |

FOREIGN PATENT DOCUMENTS

| | | |
|---|---|---|
| EP | 0 455 343 A1 | 11/1991 |
| JP | 61-156263 | 7/1986 |
| JP | 3-123364 | 5/1991 |
| JP | 4-151674 | 5/1992 |
| JP | 6-56946 | 3/1994 |
| JP | 7-72669 | 3/1995 |
| JP | 11-202548 | 7/1999 |
| JP | 2003-57883 | 2/2003 |
| JP | 2003-241440 | 8/2003 |

OTHER PUBLICATIONS

Machine English language translation of JP 06-056946.*
Machine English language translation of JP 07-072669.*
Machine English language translation of JP 2003057883.*
Machine English language translation of JP 2003241440.*
L. Deprez et al, "Digital Production Printing with UV-Curable Dry Toners for Paper and Flexible Packaging", *IS&T's NIP19:2003 International Conference on Digital Printing Technologies*, pp. 486-491.

* cited by examiner

*Primary Examiner*—Hoa Van Le
(74) *Attorney, Agent, or Firm*—Oblon, Spivak, McClelland, Maier & Neustadt, P.C.

(57) ABSTRACT

A liquid developer that comprises a colorant and a liquid for dispersing the colorant and serves to develop the latent image by causing the colorant to adhere to the latent image on the latent image carrier. The liquid comprises a first liquid comprising a photocurable liquid and a second liquid that is not mutually soluble with the photocurable liquid and comprises a liquid with a specific resistance higher than that of the photocurable liquid.

18 Claims, 6 Drawing Sheets

A-05019

FIG 8

| | RESO-LUSION | LUSTER | FIXING RATIO | WEAR RESISTANCE | SOLVENT RESISTANCE | HEAT RESISTANCE |
|---|---|---|---|---|---|---|
| WORKING EXAMPLE 1 | ○ | ○ | 99% | ○ | ○ | ○ |
| WORKING EXAMPLE 2 | ○ | ○ | 100% | ◎ | ◎ | ◎ |
| WORKING EXAMPLE 3 | ○ | ○ | 99% | ◎ | ◎ | ◎ |
| COMPARATIVE EXAMPLE 1 | ○ | △ | 80% | △ | × | × |
| COMPARATIVE EXAMPLE 2 | × | ○ | 99% | ○ | ○ | × |

◎ EXCELLENT
○ GOOD
△ FAIR
× POOR

FIG. 9

| | POSITIVE CHARGING | NEGATIVE CHARGING | MOBILITY |
|---|---|---|---|
| WORKING EXAMPLE 1 | 100% | 0% | ◎ |
| WORKING EXAMPLE 2 | 83% | 17% | ○ |
| COMPARATIVE EXAMPLE 1 | 95% | 5% | ◎ |

◎ EXCELLENT
○ GOOD

LIQUID DEVELOPER AND IMAGE FORMING APPARATUS USING SAME

BACKGROUND OF THE INVENTION

1. Field of the Invention

The present invention relates to a liquid developer that comprises a colorant and a liquid for dispersing the colorant and serves to cause the colorant to adhere to a latent image on a latent image carrier and develop the latent image and to an image forming apparatus using such a liquid developer.

2. Description of the Related Art

The conventional liquid developers are known to have a toner, which serves as a colorant, dispersed in a solvent such as a silicone oil. Liquid developers are known to be capable of using toners with a small particle size and obtaining bright images. However, with such liquid developers, if a solvent is present during image fixing, the solvent prevents the toner particles from bonding together and the toner is sometimes not fixed to the recording paper. The resultant problem is that the solvent has to be removed by using a plurality of removal rollers prior to image fixing, thereby increasing the structural complexity of the image forming apparatus using the liquid developer.

Employing photocurable liquids for the solvents is also known. The photocurable liquids have a photopolymerization initiator dissolved in a liquid composed of a monomer or oligomer having carbon-based functional unsaturated groups. If the photocurable liquid is irradiated with light such as UV rays, the photopolymerization initiator induces a radical reaction and the monomer or oligomer having carbon-based functional unsaturated groups is crosslinked and cured. The liquid developers using the photocurable liquids can be fixed to the recording paper together with the solvent and do not require an apparatus for removing the solvent, as the conventional liquid developers. Further, the toner can be fixed to the recording paper by light irradiation alone, conventional fixing of the toner by melting with heat is not required, and energy consumption of the image forming apparatus can be reduced.

However, the monomers or oligomers having carbon-based functional unsaturated groups, such as acrylates, are the substances having polarity. Therefore, the specific resistance of the solvent is low. As a result, the electric charge present on the surface of the latent image carrier moves to the liquid developer and the potential on the latent image carrier decreases, sometimes causing image bleeding or image blurring.

Japanese Patent Application Laid-open No. 2003-57883 describes using a photopolymerization initiator as a material with a high electric resistance, thereby increasing the electric resistance of the photocurable liquid. Such an increase in the electric resistance of the photocurable liquid prevents the decrease in electric potential of the latent image carrier surface and inhibits image bleeding and image blurring.

However, if the electric resistance of the photocurable liquid is increased, the amount of the photocurable liquid that electrostatically adheres to the photosensitive body surface sometimes decreases. The resultant problem is that the sufficient amount of the photocurable liquid is not present on the recording medium during fixing and a sufficient fixing ability cannot be obtained.

SUMMARY OF THE INVENTION

The present invention resolves the above-described problems and it is an object thereof to provide a liquid developer capable of inhibiting image bleeding and image blurring and of obtaining sufficient fixing ability and also to provide an image forming apparatus using such a liquid developer.

A liquid developer of the present invention causes a colorant to adhere to a latent image on a latent image carrier and develops the latent image. The liquid developer comprises a colorant; and a liquid for dispersing the colorant. The liquid comprises a first liquid comprising a photocurable liquid and a second liquid that is not mutually soluble with the photocurable liquid and comprises a liquid with a specific resistance higher than that of the photocurable liquid.

An image forming method of the present invention comprises a latent image carrier for carrying a latent image on the surface and a developer carrier for carrying a liquid developer on the surface. The method comprises the steps of causing the liquid developer sandwiched between the latent image carrier and the developer carrier to move to the latent image, forming an image on the latent image carrier, transferring the image to a recording medium, and fixing the image on the recording medium by irradiating the image transferred to the recording medium with light. In the liquid developer comprising a colorant and a liquid for dispersing the colorant and serving to develop the latent image by causing the colorant to adhere to the latent image on the latent image carrier, the liquid comprises a first liquid comprising a photocurable liquid and a second liquid that is not mutually soluble with the photocurable liquid and comprises a liquid with a specific resistance higher than that of the photocurable liquid.

An image forming apparatus of the present invention comprise a developing unit equipped with a latent image carrier for carrying a latent image on the surface and a developer carrier for carrying a liquid developer on the surface and forming an image on the latent image carrier by causing the liquid developer sandwiched between the latent image carrier and the developer carrier to move to the latent image, a transfer unit for transferring the image onto a recording medium, and a fixing unit for irradiating the image transferred to the recording medium with light and fixing the image on the recording medium. In the liquid developer comprising a colorant and a liquid for dispersing the colorant and serving to develop said latent image by causing the colorant to adhere to the latent image on the latent image carrier, the liquid comprises a first liquid comprising a photocurable liquid and a second liquid that is not mutually soluble with said photocurable liquid and comprises a liquid with a specific resistance higher than that of the photocurable liquid.

A liquid developer container of the present invention accommodates inside thereof a liquid developer for developing a latent image formed on a latent image carrier. In the liquid developer comprising a colorant and a liquid for dispersing the colorant and serving to develop the latent image by causing the colorant to adhere to the latent image on the latent image carrier, the liquid comprises a first liquid comprising a photocurable liquid and a second liquid that is not mutually soluble with the photocurable liquid and comprises a liquid with a specific resistance higher than that of the photocurable liquid.

BRIEF DESCRIPTION OF THE DRAWINGS

The above and other objects, features and advantages of the present invention will become more apparent from the following detailed description taken with the accompanying drawings in which:

FIGS. 8 and 9 show the results of evaluation tests.

DESCRIPTION OF THE PREFERRED EMBODIMENTS

An embodiment of the present invention will be described below in greater detail with reference to the appended drawings.

First, the liquid developer of the present embodiment will be explained.

Figure 1:
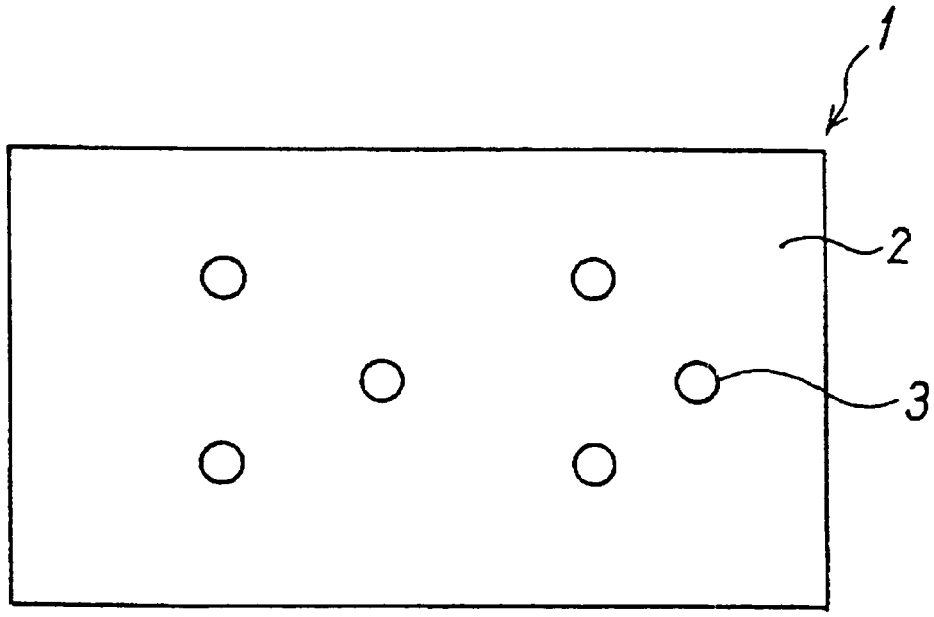
FIG. 1 illustrates a liquid developer of one embodiment of the present invention.

A liquid developer 1 of the present embodiment illustrated by FIG. 1 is prepared by dispersing a first liquid (3) comprising a thermosetting liquid having a colorant dispersed therein in a second liquid (2) with a specific resistance $10^8$ Ω·m-$10^{10}$ Ω·m and a viscosity of 10-1000 cSt. The first liquid (3) has a polarity, the second liquid (2) is nonpolar, and the first liquid (3) and second liquid (2) are mutually insoluble. Furthermore, the colorant also has a polarity and is mutually soluble with the first liquid because it has properties similar to those of the first liquid which has a polarity. The liquid developer is prepared by dispersing the first liquid in the second liquid by using a well-known emulsification method, such as a mechanical emulsification method, prior to image formation. Because the first liquid and second liquid are mutually insoluble, the first liquid assumes the form of droplets shown in FIG. 1 and floats in the second liquid (2). The smaller is the maximum diameter of the droplets of the first liquid (3), the higher is the resolution, and the droplet diameter is preferably 10 μm or less, even more preferably 2-5 μm. No specific limitation is placed on the blending ratio, but it is desired that the content ratio of the first liquid be less than 60 wt. % with respect to the second liquid. If it is higher than 60 wt. %, the droplets of the first liquid, which is present in the form of droplets in the second liquid, are highly probable to collide with each other and coalesce. As a result, the first liquid cannot be present in the form of droplets in the second liquid with good stability over a long period.

Further, appropriate additives can be dispersed in the first liquid and second liquid. As for the additive to the first liquid, it is preferred that the mutual solubility with the first liquid be increased by using a substance having a polarity similarly to the first liquid and properties similar to those of the first liquid. Examples of additives that are added to the first liquid include polymerization inhibitors, charge control agents, macromolecules that do not react with the first liquid, inorganic fillers, and the like. Those additives are described below. The additives or colorants dispersed in the first liquid should not break through the surface tension between the first liquid and second liquid and precipitate from the first liquid to the second liquid. Further, the additives and colorants dispersed in the first liquid are assumed to be substances having a polarity and also properties similar to those of the first liquid. Therefore, they have poor mutual solubility with the nonpolar second liquid. For this reason, the additives and colorants dispersed in the first liquid practically do not precipitate from the first liquid into the second liquid and remain in the first liquid. Similarly, it is preferred that the additives that are added to the second liquid be nonpolar substances, like the second liquid, have properties similar to those of the second liquid, and have increased mutual solubility with the second liquid.

The first liquid is composed of a photocurable liquid and may be a liquid curable by UV or visible radiation. The photocurable liquids are obtained by dissolving a photopolymerization initiator in a liquid composed of a monomer liquid or oligomer liquid having carbon-based functional unsaturated groups. They are classified into radical-type and cation-type liquids, depending on the type of generated polymerization initiation species, and a liquid of any type may be used. Examples of monomer liquids or oligomer liquids having carbon-based functional unsaturated groups include monomers or oligomers having an acryloyl group, a methacryloyl group, an acrylamide group, a dimaleate group, an allyl group, a vinyl ether group, a vinyl thioether group, a vinyl amino group, a glycidyl group, an epoxy group, and an acetylenic unsaturated group. Specific examples include monomer liquids such as 2-ethylhexyl acrylate, 2-hydroxyl acrylate, phenoxyethylene glycol acrylate, N-vinyl formamide, methoxytriethyleneglycol acrylate, 1,3-butanediol acrylate, epoxydized bisphenol A diacrylate, tricyclodecane dimethanol diacrylate, pentaerythritol triacrylate, epoxidized isocyanuric acid triacrylate, dipentaerythritol hexaacrylate, and phenyl octacene and oligomer liquids such as urethane acrylate, epoxy acrylates, and polyester acrylates. Those liquids can be used individually or in combinations thereof.

Examples of photopolymerization initiators serving to cure the liquids include 2,2-dimethoxy-1,2-diphenylethane-1-one, 1-hydroxycyclohexyl-phenyl-ketone, 2-hydroxy-2-methyl-1-phenyl-propane-1-one, 1-hydroxy-cyclohexyl-phenyl-ketone, benzophenone, 2-hydroxy-2-methyl-1-phenyl-propane-1-one, 1-[4-(2-hydroxyethoxy)-phenyl]-2-hydroxy-2-methyl-1-propane-1-one, 2-methyl-1-[4-(mehtylthio)phenyl]-2-morpholinopropane-1-one, 2-hydroxy-2-methyl-1-phenyl-propane-1-one, bis(2,4,6-trimethylbenzoyl)-phenylphosphine oxide, and diaryliodonium salts. These can be used individually or in combinations thereof.

It is preferred that the compounding ratio of the photopolymerization initiator be 3-10 wt. % based on the photopolymerizable liquid. If it is less than 3 wt. %, curing defects occur. Further, if it is higher than 10 wt. %, the curing reaction rate remains practically unchanged. Therefore, further increasing the content of the photopolymerization initiator causes undesirable increase in the cost of the liquid developer.

If the above-described photocurable liquid is illuminated with light, the photopolymerization initiator reacts and the monomer liquid or oligomer liquid having carbon-based functional unsaturated groups is crosslinked to a high density. As a result, the image present on the recording paper becomes a cured film and an image with excellent fixing ability, heat resistance, resistance to solvents, and wear resistance can be obtained. Furthermore, because the photocurable liquid can easily dissolve or disperse a variety of materials, it is possible to provide or control easily such properties as resolution, fixing ability, luster, heat resistance, resistance to solvents, and wear resistance.

Further, the photocurable liquid is made almost colorless with a Gardner color number of 5 or less. If the Gardner color number is more than 5, the correct hue of the image formed by the cured film on the recording paper is difficult to obtain and the hue of the output image changes.

Further, the volume shrinkage ratio induced by light illumination of the photocurable liquid is set to 20% or less. Setting the volume shrinkage ratio to 20% or less prevents the recording paper from curling.

Dyes or pigments such as carbon black, oil blue, phthalocyanine blue, phthalocyanine green, spirit black, aniline black, oil violet, benzene yellow, methyl orange, brilliant green, brilliant carmine, fast red, and crystal violet can be used as the colorants to be dispersed in the first liquid. The companioning ratio thereof is preferably within a range of 10-50 wt. % based on the first liquid. If it is less than 10 wt. %, a sufficient image density cannot be obtained. If it is higher than 50 wt. %, a sufficient light intensity cannot be obtained and curing defects occur.

Additives that are added to the photocurable liquid serving as the first liquid will be described below.

Examples of the additives that are added to the photocurable liquid serving as the first liquid include polymerization inhibitors, charge control agents, macromolecules that do not react with the first liquid, and inorganic fillers. The additives added to the first liquid are assumed to be substances having a polarity similarly to the photocurable liquid and a high mutual solubility with the first liquid.

First, polymerization inhibitors will be described.

Polymerization inhibitors are added to prevent the monomer liquid or oligomer liquid, which has carbon-based functional unsaturated groups, of the photocurable liquid from reacting and crosslinking under the effect of heat or the like. Examples of polymerization inhibitors include 2,6-di-ter-butyl-p-cresol, anthraquinone, hydroquinone, and hydroquinone monomethyl ether. Those polymerization inhibitors may be used individually or in combinations thereof. The compounding ratio of the polymerization inhibitors differs depending on the type of the first liquid, but the desirable compounding ratio is from 100 ppm to 1000 ppm based on the first liquid. If the compounding ratio is less than 100 ppm, the photocurable liquid will react under the effect of heat, even without light irradiation. If the compounding ratio is higher than 1000 ppm, sufficient curing cannot be attained even under light irradiation. The above-described compounding ratio is not limiting.

Thus, dispersing a polymerization inhibitor in the first liquid makes it possible to suppress heat-induced reactions of photocurable liquid and to obtain a stable liquid developer.

Charge control agents are explained below.

Charge control agents are added to control the amount of charge on the first liquid present in a state of droplets in the second liquid. Well-known charge control agents such as an alkyl pyrrolidone, nigrosine dyes, quaternary ammonium salts, imidazole-based complex salts, calcium dioctyl sulfonate, calcium alkylbezene sulfonate, zinc monolaurylphosphate, metal complexes of salicylic acid, organic boron salts, and metal salts of stearic acid can be used. Those agents can be used individually or in combinations thereof. The compounding ratio differs depending on the type of the first liquid, but is desirably within a range of 0.2-3 wt. % based on the first liquid.

Thus dispersing a charge control agent in the first liquid makes it possible to control the amount of charge on the first liquid with the charge control agent present in the vicinity of the surface of the first liquid present in the form of droplets in the second liquid. As a result, the amount of the first liquid enabling optical fixing can be electrostatically caused to adhere to the surface of the photosensitive body, a sufficient fixing ability can be obtained, and resolution of the output image can be increased.

Polymers that are nonreactive with the first liquid will be described below.

Polymers that are nonreactive with the first liquid are added to obtain fixing ability, strength, and flexibility of the curable film that will be cured on a recording paper. Suitable polymers may be polymers that are insoluble in the second liquid, do not decrease the specific resistance of the first liquid, and are nonreactive with the first liquid. Examples of suitable polymers include polyesters, polyurethanes, polypropylene, poly(vinyl chloride), epoxy resins, acrylic resins, polyethylene, polyols, ABS resins, and copolymers thereof. The optimum polymer depends on the type of the first liquid, but when the first liquid is an acrylate liquid, a copolymer of acryl is preferably used, for example, from the standpoint of solubility. The polymer content is desirably 50 wt. % or less based on the first liquid. If the polymer content is above this level, a sufficient crosslinking density cannot be obtained and fixing ability and wear resistance of the cured film on the recording paper are decreased.

Because using a polymer insoluble in the second liquid and nonreactive with the first liquid prevents it from decreasing the specific resistance of the first liquid, a high resolution can be maintained without decreasing the electric potential of the photosensitive body surface. Furthermore, the fixing ability of the cured film on the recording paper is improved and images excellent in heat resistance and wear resistance can be obtained.

Inorganic fillers will be described below.

Inorganic fillers are added to improve heat resistance, wear resistance, and solvent resistance of the cured film on the recording paper. Any filler may be added, provided it is composed of an inorganic material. Examples thereof include alumina, magnesia, ferrites, silica, mica, talc, zeolites, barium sulfate, and calcium carbonate; they may be used individually or in mixtures of two or more thereof. Those fillers preferably have a mean particle size of 1 μm, more preferably 0.5 μm or less. If the mean particle size is more than 1 μm, peaks and valleys appear on the contour of the image formed and the resolution decreases. The amount of the filler added is preferably 30 wt. % or less, more preferably 20 wt. % or less based on the first liquid. If it is more than 30 wt. %, a sufficient crosslinking density cannot be obtained and fixing ability and wear resistance of the cured film on the recording paper are decreased.

Thus dispersing an inorganic filler in the first liquid makes it possible to obtain images with excellent heat resistance, wear resistance, and solvent resistance.

The second liquid where the first liquid is dispersed will be explained below.

The second liquid is a nonpolar liquid that has no mutual solubility with the first liquid and has a high specific resistance of $10^8$ Ωm or more, preferably $10^{10}$ Ωm. Using the liquid with such a high resistance inhibits the movement of electric charge present on the photosensitive body surface to the liquid developer during development and suppresses the attenuation of electric potential on the photosensitive body surface. As a result, image bleeding and image blurring can be inhibited and a high-resolution image can be maintained.

Any well-known liquid can be used as the second liquid, provided that it has a high specific resistance of $10^8$ Ωm or more, preferably $10^{10}$ Ωm or more and is not mutually soluble with the first liquid. For example, hydrocarbon solvents such as n-hexane, n-pentane, n-octane, n-nonane, n-decane, n-undecane, n-dodecane and also Isoper H, Isoper G, Isoper K, Isoper M, Isoper L (trade names) manufactured by Exxon Chemical Co., Ltd., aromatic hydrocarbon solvents such as toluene and xylene, liquid silicones, and halogenated solvents such as dichloromethane and chloroform can be used. The optimum liquid depends on combination with the first liquid.

The viscosity of the second liquid is desirably within a range of 10-1000 cSt. If it is lower than 10 cSt, permeation into the recording paper increases and concentration of texture portions changes. On the other hand, if the viscosity is higher than 1000 cSt, the development and coating are difficult and irregularities occur.

Further, the environmental load can be reduced by employing a nonvolatile second liquid. A liquid silicone with a viscosity of 50 cSt or more is a nonvolatile liquid used for the second liquid in the present embodiment.

Further, an emulsifier may be added to the second liquid. Adding an emulsifier makes it possible to decrease the surface tension of the second liquid and to facilitate the emulsification (formation of droplets) of the first liquid. Further, spatial repulsion or electrostatic repulsion force created by the emulsifier makes it possible to prevent the droplets of the first liquid from coalescing and to obtain a stable liquid developer. The optimum emulsifier differs depending on combination of the first liquid and second liquid, but well-known emulsifiers can be used. Examples of emulsifiers include anionic emulsifiers such as higher fatty acid alkali salts, alkyl sulfates, alkyl sulfonates, alkyl aryl sulfonates, esters and salts of sulfosuccinic acid, and alkyl phosphates, cationic emulsifiers such as higher amine halogenates, halogenated alkyl pyridinium, and quaternary ammonium salts. Further, examples of nonionic emulsifiers include polyethylene glycol alkyl ethers, polyethylene glycol fatty acid esters, sorbitan fatty acid esters, fatty acid monoglycerides, sugar fatty acid esters, polyoxyethylene alkyl phenyl ethers, fatty acid alkanolamines, amino-modified silicones, carboxyl-modified silicones, vinyl-modified silicones, and hydroxyl-modified silicones, and examples of amphoteric emulsifiers include lecithin, alkyl imidazolinium salts; alkyl carboxyl betaine, and various amino acids.

Further, for example, if lecithin or carboxyl-modified polydimethylsiloxane is used as the emulsifier, it can also function as a charge control agent for droplets (first liquid), making it unnecessary to use a charge control agent in the first liquid. Lecithin can charge the droplets (first liquid) negatively and carboxyl-modified polydimethylsiloxane can charge them positively.

The charge characteristic of droplets (first liquid) can be improved by combining the specific charge control agent present in the first liquid with a specific emulsifier present in the second liquid. For example, when 1-octyl-2-pyrrolidone is used as a charge control agent and carboxyl-modified polydimethylsiloxane is used as an emulsifier, the amount of charge is known to increase. This is supposedly due to acid-base interaction of 1-octyl-2-pyrrolidone and carboxyl-modified polydimethylsiloxane. This is the action that draws together a substance comprising an acidic group and a substance comprising a basic group. As a result, the amount of charge on the droplets (first liquid) apparently can be increased by using a substance comprising a basic group as the charge control agent or emulsifier and using a substance comprising an acidic group as the other of the two.

An example of a copier as an image forming apparatus using the liquid developer of the present embodiment will be described below.

Figure 2:
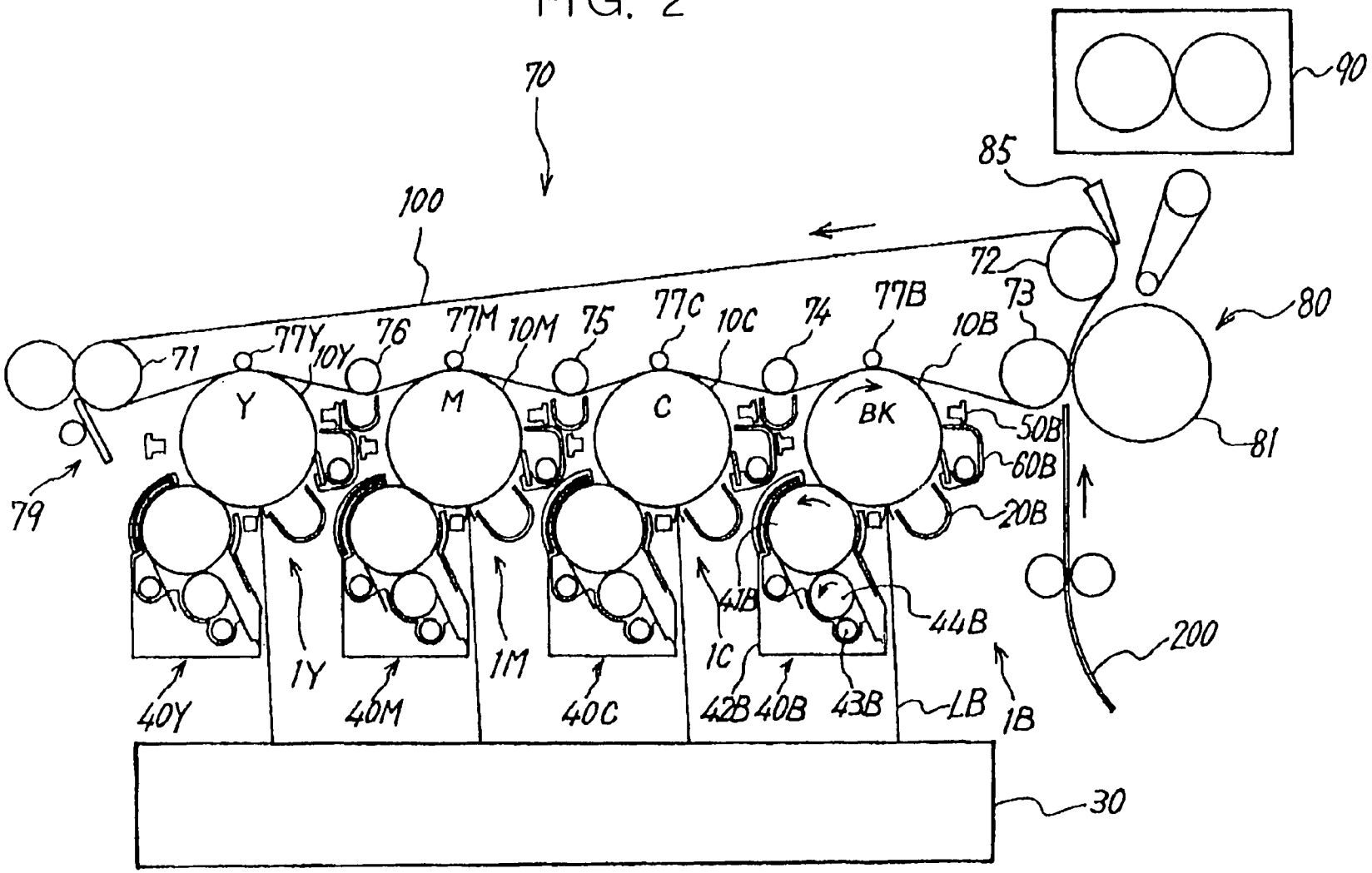
FIG. 2 illustrates a schematic configuration of the image forming apparatus using the liquid developer of the present embodiment.

FIG. 2 shows a schematic configuration of the main portion of the copier of the present embodiment. This copier comprises four image forming units 1Y, M, C, B, an intermediate transfer unit 70, a transfer unit 80, a fixing unit 90, an image reading unit (not shown in the figure) a paper supply unit, and a control unit. The four image forming units 1Y, M, C, B comprise photosensitive body drums 10Y, M, C, B and developing units 40Y, M, C, B. Further, full-color images can be formed by using yellow, magenta, cyan, and black colorants of the liquid developers of the present embodiment accommodated in the developing units 40Y, M, C, B of the image forming units 1Y, M, C, B, respectively.

Because the four image forming units 1Y, M, C, B have identical configuration, the image forming unit 1B using a black toner will be described.

A photosensitive drum 10B serving as an image carrying body, a uniform charging device 20B as charging means, a laser write unit 30 for irradiating a laser beam LB, and a wet developing unit 40B as a liquid developing device are disposed in the image forming section. Further, a charge removing unit 50B as charge removing means and a photosensitive body cleaning unit 60B having a cleaning blade are also disposed. The wet developing unit 40B has a developing roller 41B as a developer carrier and a developing tank 42B for storing the liquid developer. It further comprises a pump-up roller 43B disposed so as to be immersed in the liquid developer located inside the developing tank 42B and a metering roller 44B for forming a thin film of the liquid developer pumped up from the pump-up roller 43B and applying it to the developing roller 41B.

The intermediate transfer unit 70 has suspension rollers 71, 72, 73, 74, 75, 76 and an intermediate transfer belt 100 as an intermediate transfer body stretched over those suspension rollers 71, 72, 73, 74, 75, 76. It further comprises, for example, primary transfer bias rollers 77B, 77Y, 77M, 77C as primary transfer charge application means and a cleaning unit 79 having a cleaning blade.

The paper transfer unit 80 comprises a secondary transfer bias roller 81 as secondary transfer charge application means and a secondary transfer power source (not shown in the figure) connected to the secondary transfer bias roller 81.

The intermediate transfer belt, primary transfer bias roller, and secondary transfer bias roller will be described below.

The intermediate transfer belt 100 is stretched over the suspension rollers 71, 72, 73, 74, 75, 76 as suspension members and photosensitive drums 10B, 10Y, 10M, 10C so that it has the prescribed tension and can be rotated counterclockwise as shown by an arrow. Further, for example, the primary transfer bias roller 77B as primary transfer charge application means faces the photosensitive drum 10B, and the primary transfer bias roller 77B and photosensitive drum 10B are disposed so as to sandwich the intermediate transfer belt 100 therebetween. The primary transfer bias roller 77B also serves as the electrode for applying the primary transfer bias, and the prescribed transfer bias is applied from the primary transfer power source (not shown in the figure) to the primary transfer bias roller 77B. A secondary transfer bias roller 81 is disposed as secondary transfer charge application means opposite the suspension roller 73, and the secondary transfer bias roller 81 also serves as an electrode for applying the secondary transfer bias. The prescribed transfer bias is applied from a secondary transfer power source (not shown in the figures) to the secondary transfer bias roller 81.

The operation of the liquid development electrophotographic copier of the present embodiment will be described below.

As shown in FIG. 2, the photosensitive drum 10B is uniformly charged with the charging device 20B, while rotating the drum in the direction shown by an arrow and then the drum is irradiated with the laser beam LB from the laser write unit 30 to form an electrostatic latent image on the photosensitive drum 10B. On the other hand, the liquid developer located inside the developing tank 42B is stirred by a stirring screw (not shown in the figures). This stirring emulsifies (forms droplets) the first liquid present in the liquid developer in the second liquid. The liquid developer with the emulsified first liquid is pumped up to the metering roller 44B by the pump-up roller 43B and uniformly applied to the developing roller 41B, for example to a thickness of about 5-20 μm. Then, the developing roller 41B is brought into contact with the photosensitive drum 10B and a development nip is formed. Forming the development nip makes it possible to ensure a constant development time for the transfer and adhesion of the first liquid present in the second liquid to the photosensitive drum 10B by the development electric field of the development region. Further, the nip width, which is the size of each nip portion in the surface movement direction, can be adjusted by adjusting the contact pressure.

Figure 3:
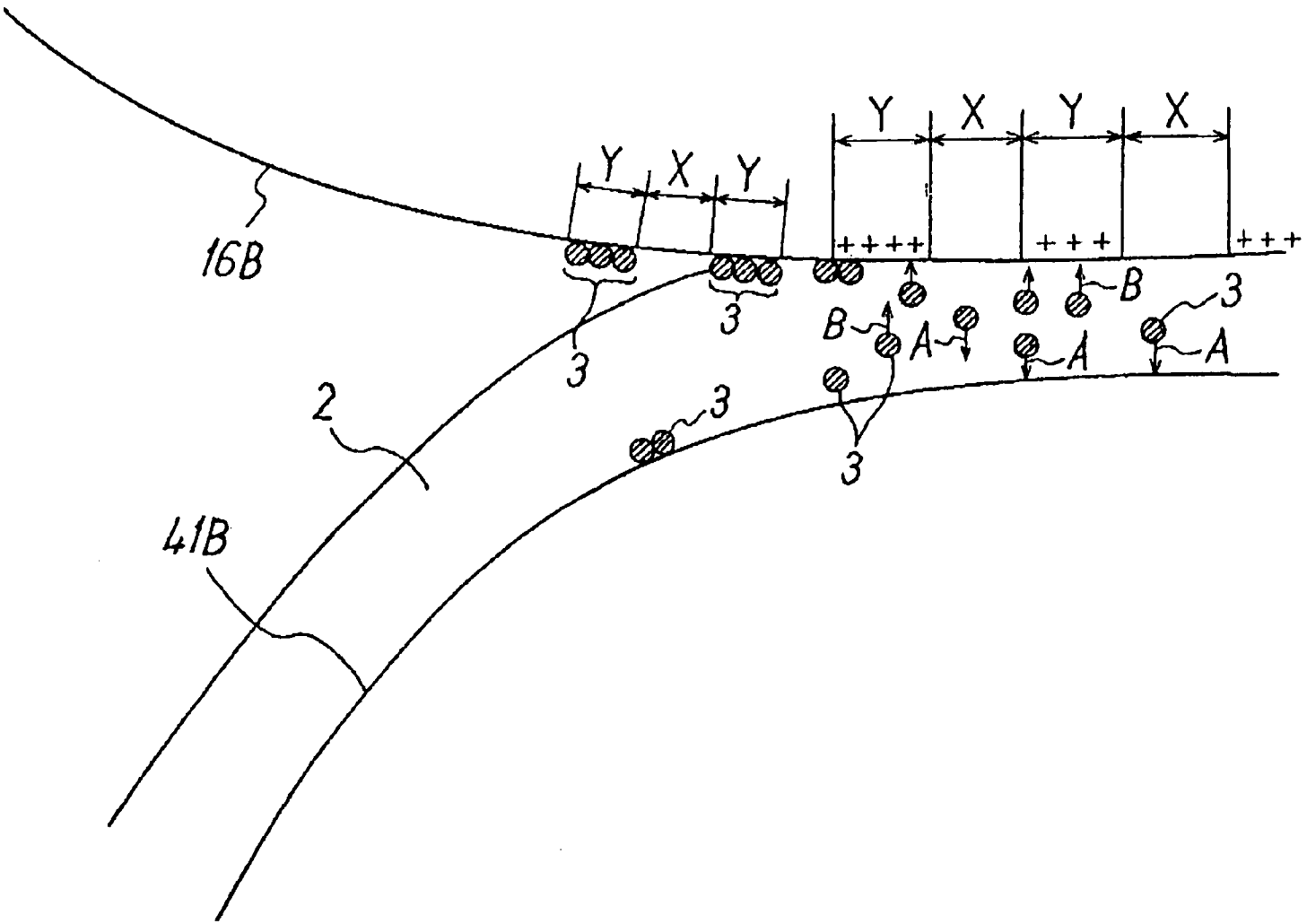
FIG. 3 is an enlarged view of the vicinity of the developing nip.

In the development nip, as shown in FIG. 3, the first liquid (3) is present in a dispersed state in the second liquid (2). The texture portion X and electrostatic latent image Y of the developing roller 41B and the photosensitive drum 10B have an electric potential of the same polarity as the first liquid, and the value thereof decreases in the order of the texture portion, developing roller 41B, and electrostatic latent image. For this reason, an electric field is formed between the texture portion X and developing roller 41B, this field causing the first liquid (3) to move electrostatically toward the developing roller 41B that has a lower electric potential. In the development nip where such a development electric field is formed, the first liquid (3) located above the developing roller 41B electrophoretically migrates between the developing roller 41B and texture X toward the surface of the developing roller 41B and assembles therein (arrow A). Further, it electrophoretically migrates between the developing roller 41B and electrostatic latent image Y toward the electrostatic latent image and adheres thereto (arrow B). Because of the adhesion, the electrostatic latent image formed on the surface of the photosensitive drum 10B is developed and a visible image is formed.

The photosensitive drum 10B where the visible image was formed is then rotated and moved to a first transfer section where the photosensitive drum 10B and intermediate transfer belt 100 abut against each other. In the first transfer section, a bias voltage of a negative polarity, that has a polarity opposite to that of the toner that has a positive polarity, is applied via the first transfer bias roller 77B to the rear surface of the intermediate transfer belt 100. For example, a voltage of −300~−500 V is applied, and the first liquid of the visible image on the photosensitive drum 10B is pulled by the electric field generated by the applied voltage to the intermediate transfer belt 100 and transferred to the intermediate transfer belt 100 (primary transfer). A full color image is likewise formed by transferring the yellow toner, magenta toner, and cyan toner on the intermediate transfer belt 100.

The intermediate transfer belt 100 with the full color toner image transferred thereto is then rotated and moved to the second transfer section where the intermediate transfer belt 100 and a recording paper 200 transported from the paper feed unit (not shown in the figure) in the direction shown by an arrow abut against each other. In the second transfer section, a bias voltage of negative polarity, for example, −800~2000 V, and a pressure of about 50 N/cm$^2$ are applied via the secondary transfer bias roller 81 to the rear surface of the recording paper. Under the effect of pressure and electric field generated by the applied voltage, the first liquid of the intermediate transfer belt 100 is pulled to the recording paper 200 and entirely transferred to the recording paper 200 (secondary transfer). The intermediate transfer unit 70 and transfer unit 80 constitute transfer means.

Then, the recording paper 200 onto which the visible image was transferred is separated from the intermediate transfer belt 100 that was attracted by a separation unit 85, the visible image present on the recording paper 200 is irradiated with the visible light or UV light with a fixing unit 90, the photocurable liquid serving as the first liquid is cured and a colorant film is formed and fixed to the transfer paper. The paper is discharged from the device after the fixing operation was completed. On the other hand, the residual charge present on the photosensitive drum 10B after the primary transfer is removed with the charge removing unit 50B, the drum surface is cleaned with the cleaning unit 60B, and the non-transferred first liquid is recovered, removed, and provided for the next image forming cycle.

FIG. 3 shows a schematic structure of the fixing unit 90. As shown in the figure, the fixing unit 90 comprises a transport unit 90*a* for transporting the recording paper and a light irradiation unit 90*b* for irradiating the visible image 200*a* present on the recording paper 200 with light. A mercury lamp, a hydrogen lamp, a deuterium lamp, a halogen lamp, a metal halide lamp, a xenon lamp, a carbon ark lamp, a fluorescent lamp, or a He—Cd laser can be used as the light source for illuminating the visible image 200*a* with light. Further, if necessary, a reflecting sheet or a lens may be used. The wavelength of the irradiation light is appropriately selected within a 300-700 nm range according to the photopolymerization initiator that will be used. The number of light irradiation cycles is appropriately determined based on the type of the photopolymerization initiator. The irradiation intensity is desirably 1-600 mJ/cm$^2$. If it is less than 1 mJ/cm$^2$, curing defects occur. If it is higher than 1000 mJ/cm$^2$, the colorants are discolored. Further, measures are taken, such as covering the fixing unit 90 with a light-shielding body, to prevent the first liquid present in the visible image or developing unit from being cured by the light leaking from the fixing unit 90 prior to fixing.

Figure 4:
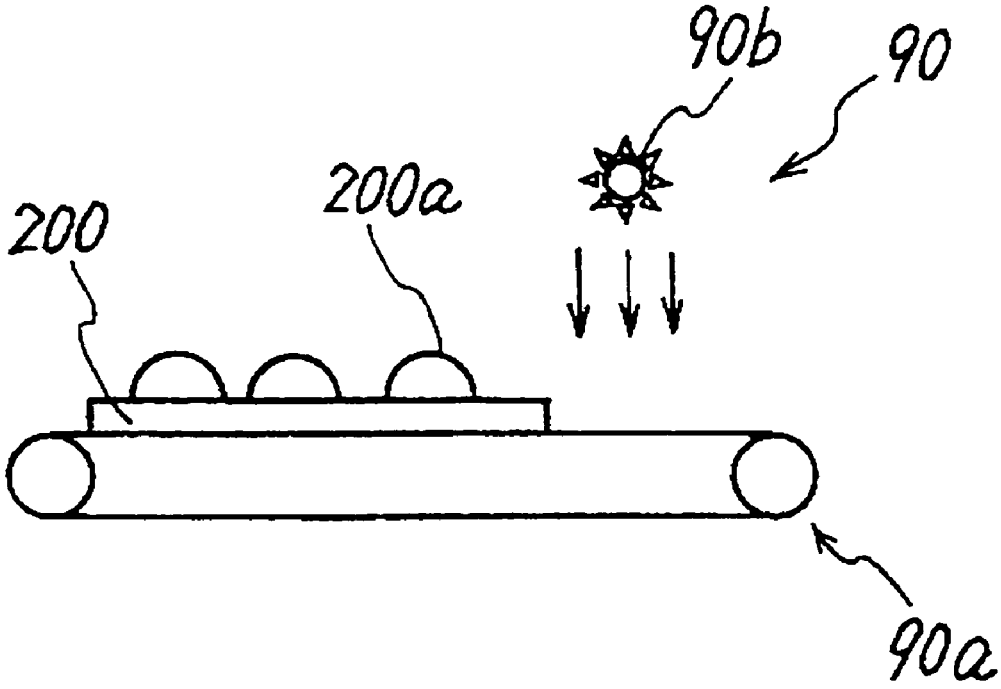
FIG. 4 shows a schematic configuration of a fixing unit.

Further, as shown in FIG. 4, in the fixing unit 90, a pressure roller 90*c* may be provided upstream of the light irradiation unit 90*b* with respect to the movement direction of the recoding paper 200 to apply pressure to the visible image 200*a* located on the recording paper 200 prior to light irradiation. Thus applying pressure to the visible image located on the recording paper 200 with the pressure roller 90*c* makes it possible to level the visible image and obtain an image with a high luster. The pressure roller 90*c* is formed from a material with high parting capability such as a fluororesin or silicone resin and the offset is inhibited. Further, a pre-irradiation unit may be provided upstream of the pressure roller 90*c* with respect to the movement direction of the recording paper and the visible image 200*a* present on the recording paper may be pre-irradiated with light to the degree at which the curing reaction is not complete. Thus conducting the pre-irradiation makes it possible to suppress further the offset caused by the pressure roller 90*c*.

The liquid developer of the present embodiment is explained below based on specific examples.

<Evaluation Test 1>

First, Evaluation Test 1 was carried out with respect to resolution, fixing ability, luster, heat resistance, and wear resistance of the fixed image obtained with the liquid developer of the present embodiment.

WORKING EXAMPLE 1

| | |
|---|---|
| Beam-Set 255N (Arakawa Chemical Industries Co., Ltd.: 580 MPa-sec, contains polymerization inhibitor) | 9.7 wt. % |
| Darocur 1773 (Nagase Industries Co., Ltd.) | 0.80 wt. % |
| OIL BLACK (Orient Chemical Industries Co., Ltd.) | 4.0 wt. % |
| Polydimethylsiloxane (Toray Dow Corning Co., Ltd.: 50 cSt) | 81 wt. % |
| One-end carboxyl-modified polydimethylsiloxane (Shin-Etsu Chemical Industries Co., Ltd.: 55 cSt) | 4.8 wt. % |
| 1-Octyl-2-pyrrolidone (Aldrich Chemicals, Inc.) | 0.081 wt. % |

A colored photocurable liquid serving as the first liquid was obtained by placing Beam-Set 255N, Darocur 1773, OIL BLACK, and 1-octyl-2-pyrrolidone into a sample tube and stirring for 1 day with a magnetic stirrer. Further, a slightly turbid transparent second liquid was obtained by dissolving the one-end carboxyl-modified polydimethylsiloxane in polydimethylsiloxane. The former photocurable liquid was gradually added to the latter solution, while it was stirred by using a homogenizer (Azuwan: rotation speed 7000 rpm). The liquid was ultrasonically dispersed for 1 h to obtain a liquid developer in which the droplets of the photocurable liquid were dispersed in the silicone oil.

WORKING EXAMPLE 2

| | |
|---|---|
| Beam-Set 255N (Arakawa Chemical Industries Co., Ltd.: 580 MPa-sec, contains polymerization inhibitor) | 9.4 wt. % |
| Darocur 1773 (Nagase Industries Co., Ltd.) | 0.78 wt. % |
| OIL BLACK (Orient Chemical Industries Co., Ltd.) | 3.9 wt. % |
| Polydimethylsiloxane (Toray Dow Corning Co., Ltd.: 50 cSt) | 78 wt. % |
| One-end carboxyl-modified polydimethylsiloxane (Shin-Etsu Chemical Industries Co., Ltd. " 55 cSt) | 4.7 wt. % |
| 1-Octyl-2-pyrrolidone (Aldrich Chemicals, Inc.) | 0.078 wt. % |
| Urethane-acryl copolymer | 3.1 wt. % |

A colored photocurable liquid serving as the first liquid was obtained by placing Beam-Set 255N, Darocur 1773, OIL BLACK, 1-octyl-2-pyrrolidone, and urethane-acryl copolymer into a sample tube and stirring for 1 day with a magnetic stirrer. Then, the operations identical to those of Working Example 1 were carried out and an liquid developer was obtained in which a polymer nonreactive with the photocurable liquid was dissolved in the droplets of the photocurable liquid.

WORKING EXAMPLE 3

An liquid developer of Working Example 3 was obtained in the same manner, except that silica particles (mean particle size 0.1 μm) were used in place of the urethane-acryl copolymer of Working Example 3.

Comparative Example 1

| | |
|---|---|
| Modified epoxy resin (Tg 50-60° C.) | 8.7 wt. % |
| Carbon black | 4.3 wt. % |
| Zirconium octylate | 0.087 wt. % |
| Polydimethylsiloxane (Toray Dow Corning Co., Ltd.: 50 cSt) | 82 wt. % |
| Lauryl methacrylate | 5 wt. % |

The modified epoxy resin and carbon black were kneaded for 30 min at 140° C. with two rolls and then ground with a mortar to give a colored resin powder. A liquid developer of Comparative Example 1 was obtained by placing the colored powder, zirconium octylate, polydimethylsiloxane, and lauryl methacrylate into a ball mill and dispersing for 24 h.

Comparative Example 2

| | |
|---|---|
| Sanwax 151P (Sanyo Chemical Industries Co., Ltd.) | 8.1 wt. % |
| Carbon black | 4.1 wt. % |
| Zirconium octylate | 0.081 wt. % |
| Beam-Set 271N (Arakawa Chemical Industries Co., Ltd.: 480 MPa-sec, contains polymerization inhibitor) | 81 wt. % |
| Darocur 1773 (Nagase Industries Co., Ltd.) | 6.5 wt. % |

The Sanwax and carbon black were kneaded for 30 min at 140° C. with two rolls and then ground with a mortar to give a colored resin powder. A liquid developer of Comparative Example 2 was obtained by placing the colored powder, zirconium octylate, Beam-Set 271N, and Darocur 1773 into a ball mill and dispersing for 24 h.

Images were produced with the image forming apparatus shown in FIG. 2 and the fixing unit 90 shown in FIG. 3 by using the liquid developers of Working Examples 1 to 3 and Comparative Examples 1 and 2, and the resolution, fixing ability, luster, heat resistance, and wear resistance of the fixed images were evaluated based on those images. In Comparative Example 1, a fixing unit equipped with the conventional heating roller was used instead of the fixing unit 90 comprising the light irradiation unit **90*b* shown in FIG. 3**.

Resolution evaluation was conducted visually. Luster evaluation was conducted by using a luster meter. The fixing ratio was evaluated by a tape peeling test. Wear resistance was evaluated with a wear test machine under the conditions of 300 cycles of reciprocal movement and a load of 500 g/cm$^2$. Heat resistance was evaluated by allowing the output image to stay for 1 min in a thermostat layer at 100° C., then wiping the image surface reciprocally 10 times with a soft cloth and evaluating the distortion of the image. Solvent resistance was evaluated by wiping the image surface 100 times reciprocally with a cloth impregnated with tetrahydrofuran and then evaluating the distortion of the image. The results are shown in FIG. 8.

As follows from FIG. 8, the results obtained demonstrated that the liquid developers of Working Examples 1 to 3 had better heat resistance, wear resistance, and solvent resistance than the liquid developer of Comparative Example 1. Thus, the colorant of the liquid developer of Comparative Example 1 on the recording paper had no coating whatsoever, whereas the colorants of the liquid developers of Working Example 1 to 3 on the recording paper were coated with the cured photocurable substance. This is apparently why the liquid developers of Working Examples 1 to 3 had heat resistance, wear resistance, and solvent resistance superior to those of the liquid developer of Comparative Example 1. With respect to the fixing ratio, too, the liquid developers of Working Examples 1 to 3 were superior to the liquid developer of Comparative Example 1. This is apparently due to the fact that in the liquid developer of Comparative Example 1, the carrier liquid that was not provided for fixing remained during image fixing, thereby hindering bonding between the toner particles and degrading the fixing ratio. With the liquid developer of Comparative Example 1, the image is fixed to the recording paper because the toner is melted on the recording paper. Therefore, if the carrier liquid that is not provided for fixing remains during image fixing, it hinders bonding between the toner particles and degrades the fixing ratio.

On the other hand, with the liquid developers of Working Examples 1 to 3, image fixation is carried out by curing a photocurable liquid by light irradiation. Therefore, even if the solvent (second liquid) that was not provided for fixing remains in a certain amount during image fixing, it produces no adverse effect on the fixing ratio. This is apparently why good fixing ability is obtained with the liquid developers of Working Examples 1 to 3. Further, with the liquid developer of Comparative Example 2, the resolution was greatly degraded with respect to that attained with other liquid developers. This is apparently because the liquid developer of Comparative Example 2 comprised a photocurable liquid with a low specific resistance and a toner and, therefore, the electric charge present on the photosensitive body surface brought into contact with the liquid developer during the development was transferred to the liquid developer, thereby reducing the surface potential of the photosensitive body. This was apparently why, the image transferred to the recording paper as blurred and good resolution could not be obtained.

On the other hand, in the liquid developer of Working Examples 1 to 3, a photocurable liquid is dispersed in the second liquid with a high specific resistance. Therefore, the electric charge present on the surface of the photosensitive body is not transferred to the liquid developer even when the photosensitive body is brought into contact with the liquid developer during the development. This is apparently why the surface potential of the photosensitive body was not decreased and the image with high resolution could be obtained. Furthermore, the results obtained demonstrated that the liquid developers of Working Examples 2 and 3 had the heat resistance, wear resistance, and solvent resistance superior to those of the liquid developer of Working Example 1. Thus, apparently because the liquid developer of Working Example 2 additionally contained the polymer nonreactive with the photocurable resin, the heat resistance, wear resistance, and solvent resistance thereof were superior to those obtained in Working Example 1. Further, apparently because the liquid developer of Working Example 3 additionally contained silica particles as an inorganic filler, the heat resistance, wear resistance, and solvent resistance thereof were superior to those obtained in Working Example 1. Furthermore, because the liquid developer of Working Example 2 additionally contained the nonreactive polymer, the fixing ratio thereof was superior to that obtained in other working examples.

<Evaluation Test 2>

Evaluation of droplet mobility and amount of charge on the droplets in the liquid developer was then conducted.

WORKING EXAMPLE 4

A liquid developer of Working Example 4 containing no charge control agent was obtained in the same manner as in Working Example 1, except that 1-octyl-2-pyrrolidone was omitted.

Figure 5:
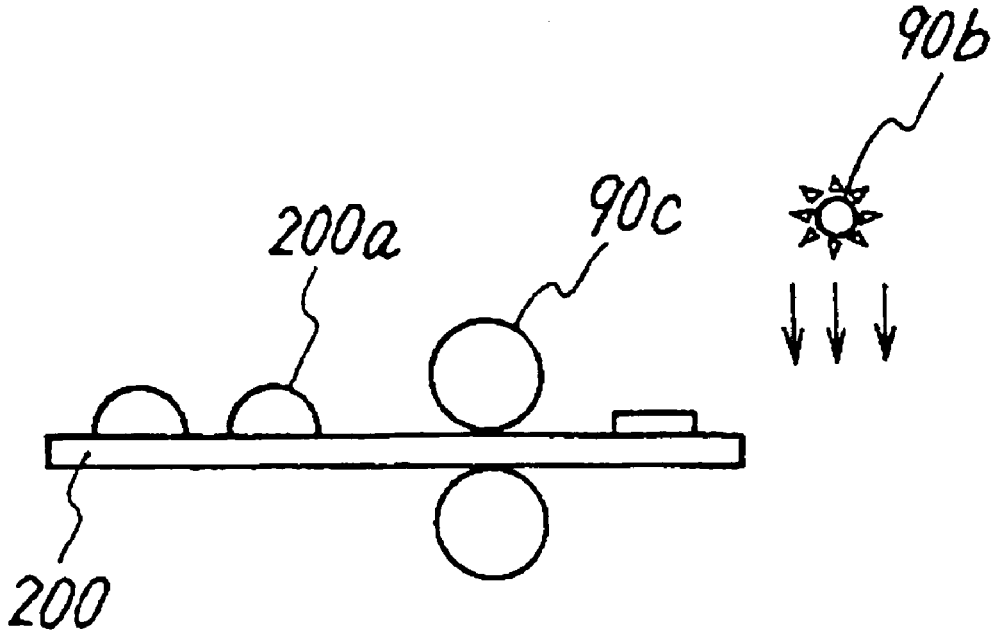
FIG. 5 shows a schematic configuration of another fixing unit.

Mobility and amount of charge were evaluated by using the liquid developers of Working Examples 1 and 3 and Comparative Example 1. First, a method for evaluating the amount of charge will be explained. Charging was conducted by using a parallel plate electrode cell 8 shown in FIG. 5. First, transparent square electrode plates 8*a* in the form of a square with one side of about 3 cm were disposed opposite each other via a gap of 0.1 mm and a liquid developer 1 was injected into the gap between the transparent electrode plates 8*a*. Then, a voltage of 1000 V was applied for 1 sec between the electrodes and the toner or first liquid was cured and fixed to the transparent electrode plates 8*a* by using a metal halide lamp. The transparent electrode plate having the toner or first liquid fixed thereto was washed using a silicone oil (volatile) with a viscosity of 1 cSt to remove the nonvolatile silicone (second liquid), followed by drying for 2 h at a temperature of 150° C. in a vacuum drier. The ratio of positively and negatively charged droplets was calculated form the transmittance of both electrodes obtained by using a spectrophotometer. The evaluation of the amount of charge was carried out by calculating the ratio of positively and negatively charged droplets. Further, the amount of charge of the liquid developer of Comparative Example 1 was evaluated by conducting the same test, except that the steps of light irradiation with a metal halide lamp and washing were omitted.

Figure 6:
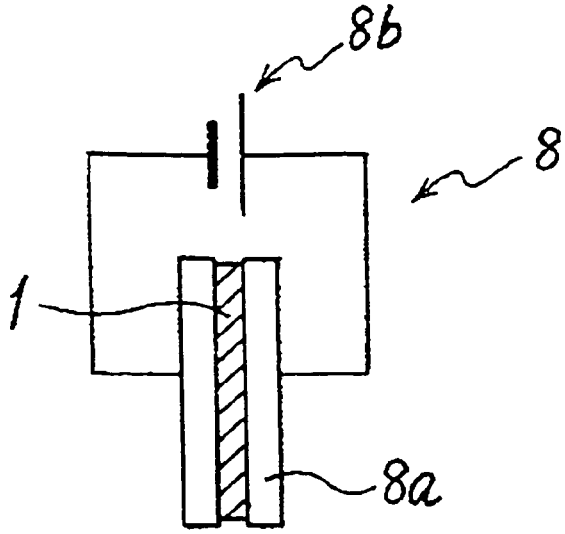
FIG. 6 shows a schematic configuration of a parallel plate electrode cell.
Figure 7:
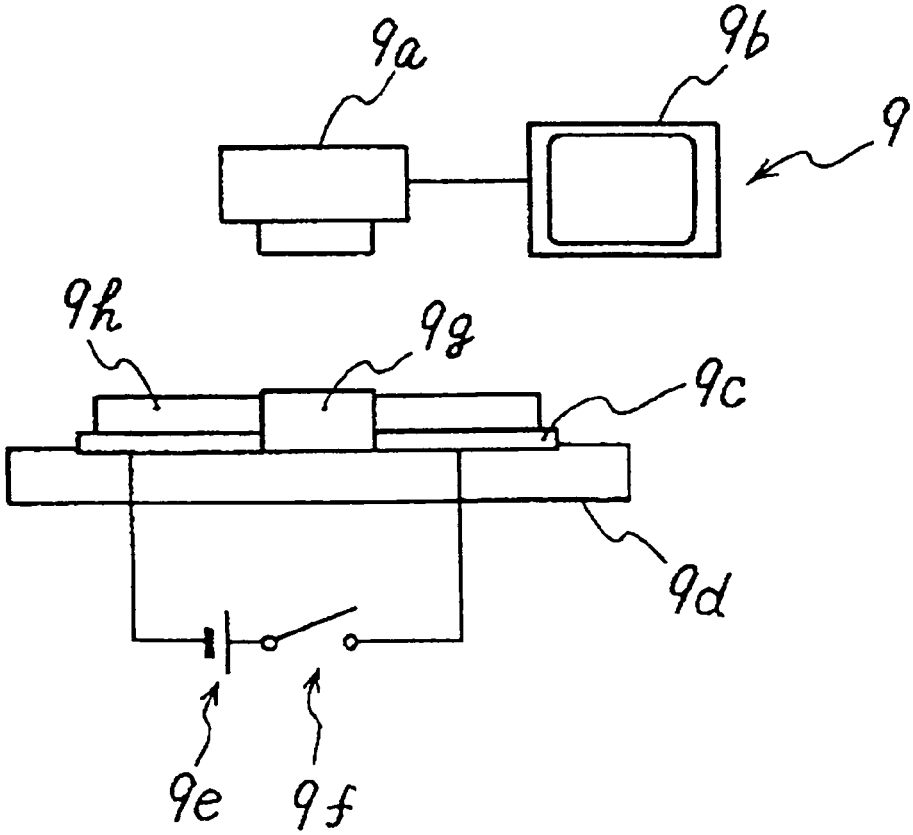
FIG. 7 shows a schematic configuration of a high-speed camera pickup device.

The mobility evaluation method will be explained below. The mobility evaluation is carried out by using a high-speed camera pick-up device 9 shown in FIG. 6. First, ITO 9*c* is deposited to 100 nm with a spacing of 100 μm on a glass substrate 9*d*, and a glass substrate 9*h* with a thickness of 25 μm is adhesively bonded thereon, providing a liquid reservoir. A liquid developer 9*g* is then injected into the liquid reservoir and a voltage of 1000 V is applied between the ITO electrodes. The pattern of droplet migration in this process is observed from above with the high-speed camera 9*a* and the mobility evaluation is carried out.

The results obtained in evaluating the mobility and amount of charge by using the above-described method for evaluating the amount of charge and mobility evaluation method are shown below in FIG. 9.

As is clear from FIG. 9, the amount of charge and mobility of the developer of Working Example 4, which uses no charge control agent, are inferior to those of Working Example 1.

<Evaluation Test 3>

Stability of the liquid developer of the present embodiment will be evaluated below.

WORKING EXAMPLE 5

A liquid developer of Working Example 5 comprising a photopolymerization initiator and a polymerization inhibitor were obtained in the same manner as described above, except that OIL BLACK and 1-octyl-2-pyrrolidone of Working Example 1 were not used.

WORKING EXAMPLE 6

A liquid developer of Working Example 6 was obtained in the same manner as in Working Example 5, except that Beam Set 255N of Working Example 5 was allowed to stay for 24 h at 80° C. under reduced pressure and the polymerization inhibitor (hydroquinone monomethyl ether) was removed.

Stability with time of the liquid developer of the present embodiment was evaluated by using the liquid developers of Working Examples 5, 6. Stability evaluation was conducted by mixing 10 mL tetrahydrofuran with 10 mL each liquid developer of Working Example 5 and Working Example 6, which were allowed to stay for 1 week in a dark room after preparation. The liquid developer of Working Example 5 was mutually soluble with tetrahydrofuran and a transparent solution was obtained. On the other hand, because the curing reaction of droplets proceeded in the liquid developer of Working Example 6, the cured substance did not dissolve and a turbid liquid was obtained. Those results confirmed that the liquid developer of Working Example 5, which had a polymerization inhibitor added thereto, was more stable with time than the liquid developer of Working Example 6, which contained no polymerization inhibitor.

<Evaluation Test 4>

Stability of droplets in the liquid developer of the present embodiment was then evaluated.

A liquid developer of Working Example 7, which contained no colorant or emulsifier, was obtained in the same manner as in Working Example 5, except that the one-end hydroxyl-modified polydimethylsiloxane was not used.

Stability of droplets was evaluated by using the liquid developers of Working Example 5 and Working Example 7. The evaluation of droplet stability was carried out by placing the liquid developers of Working Example 5 and Working Example 7 into measuring cylinders, allowing them to stay therein and measuring the time until the carrier liquid and photopolymerizable liquid started separating. It was found that in the liquid developer of Working Example 7, which contained no emulsifier, the separation started earlier than in the liquid developer of Working Example 5, which comprised an emulsifier. Those results confirmed that stability of droplets over time in the liquid developer of Working Example 5, which comprised an emulsifier, was higher than that in the liquid developer of Working Example 7, which contained no emulsifier.

<Evaluation Test 4>

Resolution, fixing ability, luster, heat resistance, wear resistance, and solvent resistance of color images obtained with the liquid developer of the present embodiment were then examined.

WORKING EXAMPLE 8

A liquid developer of Working Example 8 was obtained in the same manner as in Working Example 1, except that Disazo Yellow was used instead of OIL BLACK.

WORKING EXAMPLE 9

A liquid developer of Working Example 9 was obtained in the same manner as in Working Example 1, except that quinacridone was used instead of OIL BLACK.

WORKING EXAMPLE 10

A liquid developer of Working Example 10 was obtained in the same manner as in Working Example 1, except that Copper Phthalocyanine Blue was used instead of OIL BLACK.

Full-color images were produced with the liquid developers of Working Example 1, Working Example 8, Working Example 9, and Working Example 10 by using the image forming apparatus shown in FIG. 2 and the fixing unit 90 shown in FIG. 3 and evaluation was conducted in the same manner as in Evaluation Test 1. The fixed images produced by using the liquid developers of Working Example 1, Working Example 8, Working Example 9, and Working Example 10 were confirmed to have excellent resolution, fixing ability, luster, heat resistance, solvent resistance, and wear resistance.

<Evaluation Test 5>

The degree of curling of the recording paper and color reproducibility were then evaluated fro the liquid developer of the present embodiment.

WORKING EXAMPLE 11

A liquid developer of Working Example 11 was obtained in the same manner as in Working Example 1, except that Beam Set 101 (Arakawa Chemical Industries Co., Ltd., Gardner color number 6) was used instead of Beam Set 255N (Gardner color number 1).

WORKING EXAMPLE 12

A liquid developer of Working Example 12 was obtained in the same manner as in Working Example 1, except that dipentaerythritol hexaacrylate (volume shrinkage ratio 24.6%) was used instead of Beam Set 255N (volume shrinkage ratio 10.3%).

Images were produced with the liquid developers of Working Example 1, Working Example 11, and Working Example 12 by using the image forming apparatus shown in FIG. 2 and the fixing unit 90 shown in FIG. 3 and color reproducibility and the degree of curling of the recording paper were visually evaluated. The image formed by the liquid developer of Working Example 1, which had a Garner color number 1 of the first liquid, demonstrated bright colors, whereas the image formed with the liquid developer of Working Example 11, which had a Garner color number 6 of the first liquid of Working Example 10 had dark colors. This result demonstrates that color reproducibility is higher when the Garner color number of the first liquid is lower. Further, the recording paper having fixed thereon the image obtained with the liquid developer of Working Example 1, which had a volume shrinkage ratio of the photocurable liquid of 10.3%, did not curl. On the other hand, the recording paper having fixed thereon the image of the liquid developer of Working Example 12, which had a volume shrinkage ratio of the photocurable liquid of 24.6%, was curled. This result demonstrates that the recording paper does not curl when the volume shrinkage ratio of the photocurable liquid is low.

The following results are obtained with the liquid developer of the present embodiment.

(1) The specific resistance of the liquid developer is increased by using the second liquid with a specific resistance higher than that of the first liquid. As a result, the electric charge present on the photosensitive body is prevented from moving to the liquid developer during development and the decrease in the surface potential of the photosensitive body can be inhibited. Therefore, image bleeding and image blurring can be inhibited and a high-resolution image can be obtained. Further, because the photocurable liquid has a low electric resistance, it can be easily charged, the amount of the photocurable liquid enabling light-induced fixing can be electrostatically caused to adhere to the surface of the latent image carrier, and a sufficient fixing ability can be obtained.

(2) In the liquid developer of the present embodiment, a colorant is dispersed in the first liquid. As a result, the colorant together with the first liquid can be attached electrostatically to the latent image on the photosensitive body surface.

(3) Because the first liquid comprises a polymerization initiator, the heat-induced reaction of the photocurable liquid can be inhibited and a liquid developer stabilized for a long interval can be obtained.

(4) Because the first liquid comprises an charge control agent, the amount of charge of the first liquid can be controlled. As a result, the amount of the photocurable liquid enabling light-induced fixing can be electrostatically attached to the surface of the photosensitive body and sufficient fixing ability can be obtained.

(5) The first liquid comprises a polymer insoluble in the second liquid and nonreactive with the first liquid. Because the polymer is insoluble in the second liquid, it does not decrease the specific resistance of the second liquid. As a result, the decrease in surface potential of the photosensitive body can be inhibited and high-resolution images can be maintained. Furthermore, fixing of the images can be improved and heat resistance, wear resistance, and solvent resistance of the fixed images can be increased.

(6) Because the first liquid comprises an inorganic filler, heat resistance, wear resistance, and solvent resistance of the fixed images can be increased.

(7) The substances comprises in the first liquid have the same polarity as the photocurable liquid of the first liquid and properties similar to those of the photocurable liquid. As a result, the substances comprises in the first liquid are easily collected in the first liquid, and the colorant, charge control agent, and polymerization inhibitor comprised in the first liquid do not precipitate from the first liquid into the second liquid. As a result, the colorant, charge control agent, and polymerization inhibitor can be sufficiently functional even when added in small amounts to the first liquid.

(8) Because the Gardner index of the photocurable liquid is set to 5 or less, color reproducibility of the fixed image can be maintained.

(9) Because the volume absorption ratio of the photocurable liquid is set to 20% or less, the recording paper after image fixing is prevented from curling.

(10) Because the specific resistance of the second liquid is set to $10^8$ Ωm or more, the electric charge present on the surface of the photosensitive body is prevented form moving to the liquid developer during development and the decrease in the surface potential of the photosensitive body is inhibited. As a result, image bleeding and image blurring can be inhibited and high-resolution images can be maintained.

(11) Because the second liquid is nonvolatile, the environmental load can be reduced.

(12) If the first liquid and second liquid are in a state of separation, for example, only the first liquid is brought into contact with the photosensitive body surface during development, the electric potential of the photosensitive body surface is reduced, and an image with poor resolution is obtained. Conversely, if the second liquid is brought into contact with the photosensitive body surface during development, the amount of the first liquid that is electrostatically caused to adhere to the photosensitive body surface is decreased and a sufficient fixing ability cannot be obtained. However, because the first liquid is dispersed in the second liquid, the liquid developer brought into contact with the photosensitive body surface can be provided with a high electric resistance, the potential of the photosensitive body is not reduced, and high-resolution images can be maintained. Further, because the first liquid is present in the vicinity of the photosensitive body surface during development, the first liquid can be electrostatically caused to adhere in a sufficient amount to the latent image on the photosensitive body surface and a sufficient fixing ability can be obtained.

(13) Because the second liquid comprises an emulsifier, the first liquid can be present in the form of droplets in the second liquid with good stability over a long period.

(14) Because the first liquid is contained in the second liquid in an amount of 60 wt. % or less, the probability of collisions between the droplets of the first liquid present in the second liquid is reduced and the droplets of the first liquid are prevented from coalescing. As a result, the first liquid can be present in the form of droplets in the second liquid with good stability over a long period.

(15) Furthermore, with the image forming method of the present embodiment, an image is formed by using the above-described liquid developer. Therefore, an image with good resolution, heat resistance, wear resistance, and solvent resistance can be obtained. Furthermore, because the image can be fixed to the recording paper with light, the image can be formed with lower energy consumption than with the conventional thermal fixing.

(16) With the image forming method of the present embodiment, a pressure is applied to the image transferred onto the recording medium and then the image transferred onto the recording medium is irradiated with light to fix the image to the recording medium. As a result, the application of pressure makes it possible to level the image present on the recording paper and to obtain a high-luster image.

Various modifications will become possible for those skilled in the art after receiving the teachings of the present disclosure without departing from the scope thereof.

What is claimed is:

1. A liquid developer for causing a colorant to adhere to a latent image on a latent image carrier and developing said latent image, comprising:

a colorant; and a liquid for dispersing said colorant; wherein said liquid comprises a first liquid comprising a photocurable liquid and a second liquid that is not mutually soluble with said photocurable liquid and comprises a liquid with a specific resistance higher than that of said photocurable liquid.

2. The liquid developer as claimed in claim 1, wherein said colorant is dispersed in the first liquid.

3. The liquid developer as claimed in claim 1, wherein said first liquid comprises a polymerization inhibitor.

4. The liquid developer as claimed in claim 1, wherein said first liquid comprises a charge control agent.

5. The liquid developer as claimed in claim 1, wherein said first liquid comprises a polymer that is insoluble in said second liquid and nonreactive with said first liquid.

6. The liquid developer as claimed in claim 1, wherein said first liquid comprises an inorganic filler.

7. The liquid developer as claimed in claim 1, wherein a substance contained in said first liquid has a polarity.

8. The liquid developer as claimed in claim 1, wherein the Gardner color number of said photocurable liquid is 5 or less.

9. The liquid developer as claimed in claim 1, wherein the volume absorption coefficient of said photocurable liquid is 20% or less.

10. The liquid developer as claimed in claim 1, wherein the specific resistance of said second liquid is $10^8$ Ωm or more.

11. The liquid developer as claimed in claim 1, wherein said second liquid is nonvolatile.

12. The liquid developer as claimed in claim 1, wherein said first liquid is dispersed in said second liquid.

13. The liquid developer as claimed in claim 1, wherein said second liquid comprises an emulsifier.

14. The liquid developer as claimed in claim 1, wherein said first liquid is contained at 60 wt. % or less with respect to said second liquid.

15. An image forming method comprising a latent image carrier for carrying a latent image on the surface and a developer carrier for carrying a liquid developer on the surface and comprising the steps of causing the liquid developer sandwiched between said latent image carrier and said developer carrier to move to said latent image, forming an image on the latent image carrier, transferring said image to a recording medium, and fixing the image on said recording medium by irradiating the image transferred to said recording medium with light, wherein in the liquid developer comprising a colorant and a liquid for dispersing said colorant and serving to develop said latent image by causing said colorant to adhere to the latent image on the latent image carrier, said liquid comprises a first liquid comprising a photocurable liquid and a second liquid that is not mutually soluble with said photocurable liquid and comprises a liquid with a specific resistance higher than that of said photocurable liquid.

16. The image developing method as claimed in claim 15, wherein the image is fixed on said recording medium by irradiating the image that is transferred onto said recording medium with light after applying pressure to the image transferred to said recording medium.

17. An image forming apparatus comprising a developing unit equipped with a latent image carrier for carrying a latent image on the surface and a developer carrier for carrying a liquid developer on the surface and forming an image on the latent image carrier by causing the liquid developer sandwiched between said latent image carrier and said developer carrier to move to said latent image, a transfer unit for transferring said image onto a recording medium, and a fixing unit for irradiating the image transferred to said recording medium with light and fixing the image on said recording medium, wherein in the liquid developer comprising a colorant and a liquid for dispersing said colorant and serving to develop said latent image by causing said colorant to adhere to the latent image on the latent image carrier, said liquid comprises a first liquid comprising a photocurable liquid and a second liquid that is not mutually soluble with said photocurable liquid and comprises a liquid with a specific resistance higher than that of said photocurable liquid.

18. A liquid developer container for accommodating inside thereof a liquid developer for developing a latent image formed on a latent image carrier, wherein in the liquid developer comprising a colorant and a liquid for dispersing said colorant and serving to develop said latent image by causing said colorant to adhere to the latent image on the latent image carrier, said liquid comprises a first liquid comprising a photocurable liquid and a second liquid that is not mutually soluble with said photocurable liquid and comprises a liquid with a specific resistance higher than that of said photocurable liquid.

* * * * *